US005125507A

United States Patent [19]

Graziano, Jr.

[11] Patent Number: 5,125,507

[45] Date of Patent: Jun. 30, 1992

[54] GOLF BAG HAVING A MOUTH SHAPED AS A TRUNCATED TRIANGLE

[76] Inventor: Joseph M. Graziano, Jr., 300 Church St., Burlington, Wis. 53105

[21] Appl. No.: 672,164

[22] Filed: Mar. 19, 1991

[51] Int. Cl.[5] ..... A63B 55/00

[52] U.S. Cl. ..... 206/315.6; 280/DIG. 6

[58] Field of Search ..... 206/315.2-315.8; D3/36; 280/DIG. 6, DIG. 5

[56] References Cited

U.S. PATENT DOCUMENTS

| | | | |
|---|---|---|---|
| Re. 33,203 | 4/1990 | Reimers | 206/315.5 |
| D. 316,779 | 5/1991 | Henrickson et al. | D3/36 X |
| 1,672,549 | 6/1928 | Thompson | 206/315.6 |
| 1,939,488 | 12/1933 | Dent et al. | 206/315.8 |
| 2,047,079 | 7/1936 | MacMurray | 206/315.5 X |
| 2,368,752 | 2/1945 | Duis | 280/DIG. 6 X |
| 2,559,981 | 7/1951 | McBride | 224/5 |
| 2,602,676 | 7/1952 | Fieldhouse | 280/DIG. 6 X |
| 2,629,609 | 2/1953 | Wilson | 280/36 |
| 2,708,955 | 5/1955 | Wilkins | 206/315.6 |
| 2,749,958 | 6/1956 | Innes | 206/315.6 X |
| 2,860,679 | 11/1958 | Kouke | 206/315.6 X |
| 2,890,061 | 6/1959 | Watson | 206/315.6 X |
| 2,938,559 | 5/1960 | Harkrader | 206/315.6 |
| 2,957,707 | 10/1960 | Zagwyn | 280/124 |
| 3,503,518 | 3/1970 | Black | 206/315.6 X |
| 3,674,072 | 7/1972 | Shuto | 206/315.6 |
| 3,918,735 | 11/1975 | Denzer et al. | 280/36 C |
| 4,055,207 | 10/1977 | Goodwin | 206/315.6 |
| 4,172,484 | 10/1979 | Henning | 206/315.6 |
| 4,319,616 | 3/1982 | Light | 206/315.2 |
| 4,332,283 | 6/1982 | Rader | 206/315.6 |
| 4,340,102 | 7/1982 | Isabel | 206/315.6 |
| 4,552,299 | 6/1985 | Clark et al. | 206/315.3 |
| 4,655,346 | 4/1987 | Reinholz | 206/315.6 |
| 4,664,382 | 5/1987 | Palmer et al. | 273/77 A |
| 4,778,136 | 10/1988 | Reimers | 248/96 |
| 4,784,401 | 11/1988 | Raquet | 280/40 |
| 4,995,510 | 2/1991 | Fletcher, Jr. | 206/315.3 X |

FOREIGN PATENT DOCUMENTS

| | | | |
|---|---|---|---|
| 358195 | 10/1931 | United Kingdom | 206/315.3 |

*Primary Examiner*—Sue A. Weaver
*Attorney, Agent, or Firm*—Jansson & Shupe, Ltd.

[57] ABSTRACT

An improved golf bag is generally V-shaped and has two rows of openings, each of which is identified to a particular club. The inventive bag arranges the clubs so that those which stand higher are at the rear of the bag. The clubs are therefore presented in an orderly, easily-visible array making the clubs exceptionally easy to select. The bag has soft, generally flat sides which are comfortable for the user when the bag is carried by its shoulder strap. The triangular base gives the bag more stability when stood on its end. The V-shape of the bag and the absence of straps or other obstructions from its apex edge accommodates it well to mounting on hand-pulled golf carts.

12 Claims, 3 Drawing Sheets

FIG. 2
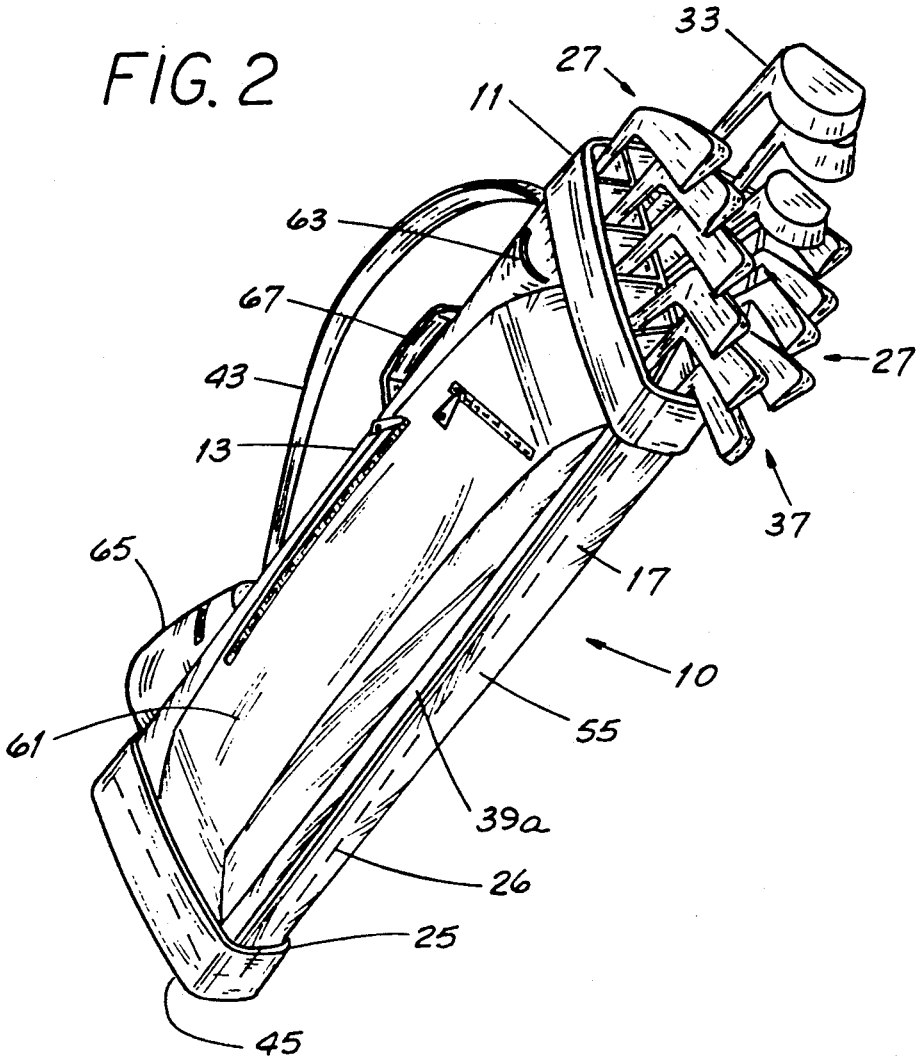
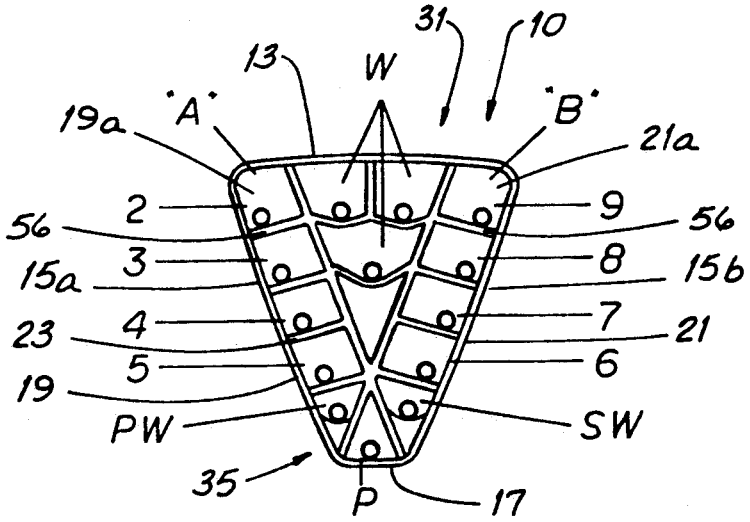
FIG. 4

GOLF BAG HAVING A MOUTH SHAPED AS A TRUNCATED TRIANGLE

FIELD OF THE INVENTION

This invention relates generally to sports equipment and, more particularly, to golf bags.

BACKGROUND OF THE INVENTION

There has been a recognition among golf bag designers that a bag arrangement permitting quick club selection and overall ease of bag use are features sought after by golfers. Such designers have approached the problem in varying ways—and with varying degrees of success.

An example of one approach is shown in U.S. Pat. No. 4,664,382 (Palmer et al.). The arrangement shown therein involves clubs, each having a shortened shaft to which is attached a detachable portion when that particular club is selected for use. The "stubbed" clubs are carried in three rows of tube-like receptacles having progressively greater lengths and arranged to form a stepped configuration. When the clubs are installed, their heads will be at different levels for, it is said, "easy selection." None of the receptacles are identified to a particular club and there is no apparent provision for woods. The bag has a somewhat triangular shape when unzipped ready for use and a carrying strap is attached at the "apex" of the triangle.

Another approach is shown in U.S. Pat. No. 2,938,559 (Harkrader) which relates to a club holder insert for a golf bag. The insert appears to be a rigid structure and has multiple holes arranged in three rows. Each hole is intended to receive the shaft of a particular club. While the holes are so identified, the "pattern" of identification is distinctly other than orderly and, in fact, seems rather random. It is likely that such club identification arrangement would take a good deal of "getting used to" and even then may not be intuitive.

Still another approach is shown in U.S. Pat. No. 2,047,079 (MacMurray) and involves a golf "bag" or club rack of rigid construction. The exterior surfaces are "corrugated," thereby presenting a rough, hard surface to the user's body as the bag is carried. The rack is triangular in shape and has a shoulder strap attached at the apex. Interestingly, the pouches (presumably for a coat, umbrella or the like) are inconveniently inside the bag rather than outside. The tubular containers are not identified to a particular club.

U.S. Pat. No. 2,860,679 (Kouke) shows a rigid rack to be inserted into a golf bag. The rack has plural openings to receive the shafts of clubs. Only one of them, the putter, is identified to a particular club, because of its asserted oval handle shape.

U.S. Pat. No. 4,522,299 (Clark et al.) shows a rigid polyethylene golf club bag intended (apparently) only for carrying by cart. U.S. Pat. No. 4,332,283 (Rader) shows a round golf bag assembly having a plate with plural apertures. Bags with round bottom surfaces tend to be somewhat unstable when stood on end. The plate is "stepped" to accommodate clubs having shafts of various lengths. None of the apertures are identified to a particular club. Other golf bag arrangements are shown in U.S. Pat. Nos. 2,559,981 (McBride); 1,939,488 (Dent et al.) and 2,749,958 (Innes).

The golf bag arrangements shown in the foregoing patents have been generally satisfactory but nevertheless are attended by certain disadvantages. One disadvantage is that with the exception of the bag shown in the Harkrader patent, there are no location "identifiers" for particular clubs. And the identifiers shown in the Harkrader patent (together with the accompanying holes) are arranged in what may be said to be a rather random, disorderly way that is difficult to "memorize" and use. Other bags, like those shown in the MacMurray and Clark et al. patents have hard outer surfaces and that of MacMurray is rough, as well.

And certain of the bags do not well accommodate the needs of golfer using hand-pulled carts. Such carts often have a V-shaped space for receiving the bag. The apex of a triangular bag should be devoid of straps and the like to fit well against the stem of the cart. While the bags of the MacMurray, Dent et al. and Palmer et al. patents are somewhat V-shaped, their apexes are obstructed by straps. Thus, they do not fit well into such carts—and when they are so mounted, the straps are inaccessible.

An improved golf bag which overcomes such disadvantages would be an important advance in the art.

OBJECTS OF THE INVENTION

It is an object of the invention to provide an improved golf bag which overcomes some of the problems and shortcomings of the prior art.

Another object of the invention is to provide an improved golf bag which presents an orderly, easy-to-use array of readily-visible clubs including irons and woods.

Still another object of the invention is to provide an improved golf bag having soft, relatively flat sides for more comfortable carrying against the body.

Yet another object of the invention is to provide an improved golf bag, the construction of which helps maintain clubs in alignment for easier viewing and selection while yet avoiding the use of club-holding "tubes."

Another object of the invention is to provide an improved golf bag which is more stable when stood on end.

Another object of the invention is to provide an improved golf bag compatible with hand-pulled carts.

How these and other objects are accomplished will become more apparent from the following detailed description taken in conjunction with the drawing.

SUMMARY OF THE INVENTION

As explained below, the improved golf bag incorporates several features, each of which is intended to eliminate some the annoyances which often attend the game of golf.

The improved bag includes an upper mouth generally defining a slightly "blunt-nosed" or truncated triangle. The mouth has a base edge and a pair of side edges extending from the base edge and converging at a narrow apex edge. A row of openings extends generally parallel to each of the two side edges and each opening in each row is "identified" to a particular iron. Such identification is by placing a number or symbol next to the opening, each number or symbol corresponding to that of a particular iron. In that way, all irons are retained in an ordered arrangement and a particular iron is easily selected from the bag.

In a highly preferred embodiment of the invention, the openings of one row are identified to receive even numbered irons while those of the other row are identified to receive odd-numbered irons. When so arranged with the numbers in ascending order from the base edge to the apex edge, the lengths of the shafts decrease slightly club to club. Therefore, the heads of the irons are more easily viewed from a vantage point near the apex edge. In another preferred embodiment, each row has openings numbered in sequence. Although this latter arrangement may not provide the "club exposing" arrangement of the former embodiment, it nevertheless presents the clubs in an ordered arrangement. In either embodiment, club selection therefore quickly becomes virtually intuitive.

The improved golf bag also has an area interposed between the rows of iron and adjacent the base edge for receiving woods. Since the woods have shafts longer than those of the irons, the woods are readily visible when the club heads are viewed from near the apex edge. There is another area adjacent to the apex edge for receiving "short-game" clubs, i.e., a pitching wedge, a sand wedge and a putter.

The unique golf bag also has a base or bottom portion and a pair of interior separator webs extending between the mouth and the bottom portion. One such web is inward of each row and spaced from and generally parallel to a side panel. When so arranged, each web and its adjacent side panel define a slot-like space extending the length of the bag.

With the irons in place in the bag, each web and panel generally prevent the club shafts from moving laterally (toward or away from the side panel) out of alignment with one another. And the thicknesses of the shafts and their generally row-like relationship help keep the shafts from moving longitudinally (toward or away from the apex) out of alignment with one another. Therefore, since the shafts are relatively well aligned, the heads of irons are likewise maintained generally in alignment. This provides not only a very neat appearance but an orderly "array" of clubs from which the desired club may be quickly selected.

The new bag has a number of other desirable features. For example, the bag includes a shoulder strap preferably attached along the base panel. The side panels are soft and generally flat to comfortably "hug" the user's body when carried by the shoulder strap.

The bottom portion of the bag has a triangular shape and a generally flat ground-contacting surface. It may be said that when the bag is stood upright and rested on the bottom portion, its "footprint" is triangular. The bag therefore has a better degree of surefootedness or stability against tipping than do conventional bags with round bottom portions. With such more stable arrangement, players find it less-frequently necessary to lay the bag on the ground.

The new bag also accommodates the needs of the multitude of golfers who use a two-wheeled hand-pulled bag cart. Many such carts have a rigid bar-like stem extending between the wheel frame and the handle. Upper and lower V-shaped bag retention brackets are attached to the stem and diverge outward to receive and secure the bag, usually with straps extending between bracket ends. The inventive bag includes an apex panel devoid of straps and pockets. Such panel, being free of obstructions, may therefore be positioned closely adjacent and generally parallel to the cart stem for more secure bag carrying. That is, the generally V-shaped bag and the absence of obstructions on the apex panel provide a "cart-conforming" or "bracket-conforming" shape. And the shoulder strap, being positioned away from the cart, is readily accessible for easier bag mounting and later removal from the cart.

DESCRIPTION OF THE DRAWING

FIG. 2 is a second perspective view of the bag of FIG. 1 showing another side thereof in conjunction with golf clubs.

FIG. 4 is a top plan view of another embodiment of the bag of FIG. 1.

DETAILED DESCRIPTION OF PREFERRED EMBODIMENTS

Figure 1:
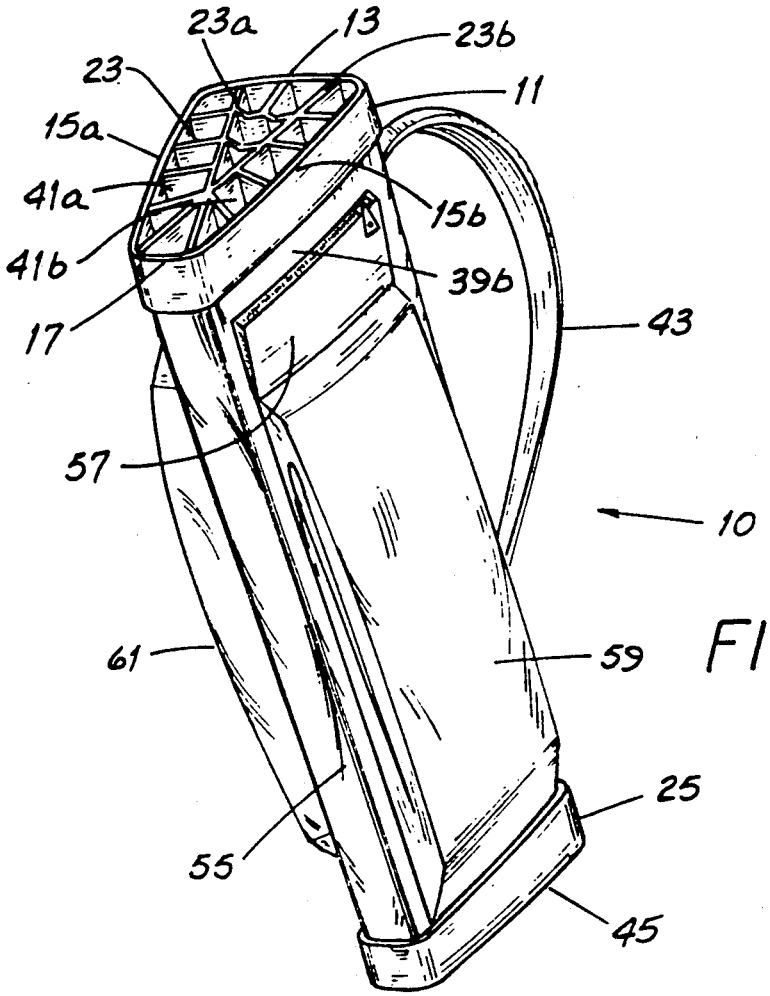
FIG. 1 is a first perspective view of the improved golf bag showing one side thereof.
Figure 3:
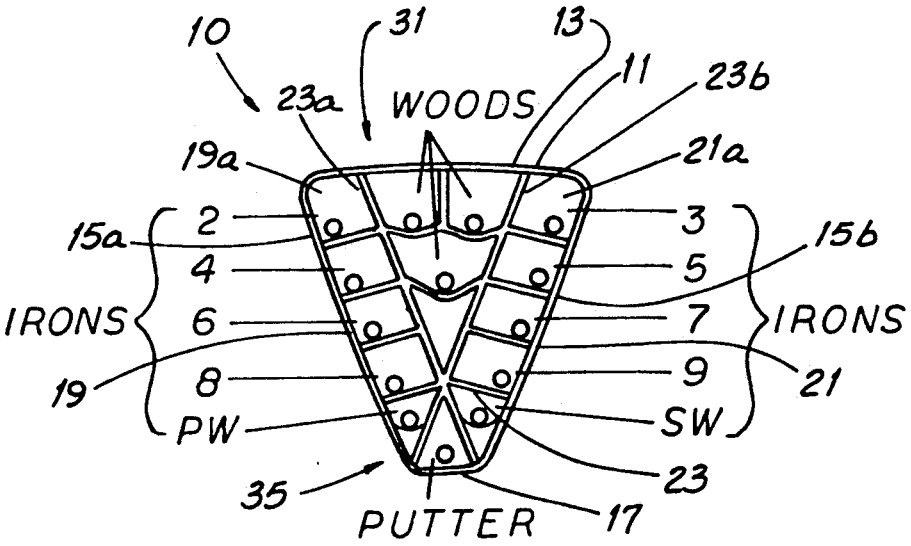
FIG. 3 is a top plan view of one embodiment of the bag of FIG. 1.

Referring first to FIGS. 1 and 3, the improved golf bag 10 includes an upper mouth 11 into which club shafts are inserted. The mouth 11 has a slightly outwardly-curved rear or base edge 13 and a pair of generally straight side edges 15*a*, 15*b* extending from the base edge 13. Such side edges 15*a*, 15*b* converge at a relatively narrow, slightly outwardly-curved front or apex edge 17. Such edges 13, 15*a*, 15*b*, 17 generally define a somewhat "blunt-nosed" or truncated triangle.

As best seen in FIG. 3, a first row 19 of openings 19*a* extends generally parallel to the edge 15*a* and a second row 21 of openings 21*a* extends generally parallel to the edge 15*b*. Each opening 19*a*, 21*a* in each row 19, 21 is "identified" to a particular iron 27. Such identification is by placing a number or symbol next to each opening 19*a*, 21*a*, each number or symbol corresponding to that of a particular iron 27. Suitable numbers and symbols correspond to the actual number of the iron 27, e.g., 2, 5, 8 or to the name of the iron 27, e.g., the symbol "PW" for pitching wedge, "SW" for sand wedge and "P" for putter. Identifiers such as 1W, 3W and the like may be used for woods 33.

At least portions of the upper mouth 11 are preferably made by molding and such numbers and symbols may be molded into the material. Another way of applying such identifiers is by pressure-sensitive labels adjacent to each opening 19*a*, 21*a*.

For reasons that will become apparent, the pattern of the identifying nomenclature is readily memorized and virtually intuitively used by the bag owner. With openings 19*a*, 21*a* for irons 27 so identified, all irons 27 are retained in an ordered arrangement and a particular iron 27 is easily selected from the bag 10. It is to be appreciated that with the exception of webs 23*a*, 23*b* as explained below, the webs 23 defining the openings 19*a*, 21*a* do not extend vertically to the bottom portion 25 of the bag 10.

In one preferred embodiment of the invention shown in FIG. 3, the openings 19*a* of one row 19 are identified to receive even-numbered irons 27 while those openings 21*a* of the other row 21 are identified to receive odd-numbered irons 27. In a highly preferred version, such numbers are arranged in ascending order from the base edge 13 to the apex edge 17 as shown. When so arranged, the lengths of the shafts decrease slightly club-to-club when considered from the rear or base edge 13 to the front or apex edge 17. Therefore, the heads of the irons 27 diminish in height from rear to front (as shown in FIG. 2) and are much more easily viewed from a vantage point near the front of the bag 10. To put it another way (and referring also to FIG. 3) each row 19, 21 contains irons 27 having progressively shorter shafts as the row 19, 21 is viewed from the base edge 13 to the apex edge 17. Therefore, the heads of longer-shafted irons 27 protrude from the bag 10 a distance greater than the heads of shorter-shafted irons 27. As will become apparent, at the bag front is the normal vantage point, irrespective of whether the bag 10 is being shoulder-carried or carried on a cart 29. It is to be appreciated that the new bag 10 provides such advantage of easy viewing and quick club selection irrespective of whether even-numbered and odd-numbered irons 27 are to the left and right, respectively, as viewed in FIG. 3 or whether they are to the right and left, respectively.

In another preferred version, the openings 19*a*, 21*a* may also be identified with even-numbered irons 27 and odd-numbered irons 27 in descending order from the base edge 13 to the apex edge 17. While such arrangement does not provide quite the easily-viewed "club exposing" arrangement as that described above, it is nevertheless highly orderly. In yet another preferred embodiment shown in FIG. 4, each row 19, 21 has openings 19*a*, 21*a* numbered in sequence. And sequential numbering need not be as shown in FIG. 4. For example, sequential numbering could begin at "A" and proceed down the left row 19 and up the right row 21 to "B." Or it could begin at "B" and proceed down the right row 21 and up the left row 19 to "A." Yet another possibility is to start near the apex edge 17 and sequentially number in an upward direction (as seen in FIGS. 3 or 4) in either row 19 or 21 and in a downward direction in the other row 21 or 19.

Each of the foregoing club-identifying arrangements is highly orderly, easily memorized and virtually intuitive. For those reasons, users of the improved bag 10 find renewed enjoyment in the game of golf since, at last, they are freed of the need to search for a particular club among clubs arranged in a random pattern—or no pattern.

Referring particularly to FIGS. 3 and 4, the improved golf bag 10 also has an area 31 interposed between the rows 19, 21 of irons and adjacent the base edge 13 for receiving woods 33. Specifically, such area 31 is between the outer divergent ends of the edges 19, 21. Since the woods 33 have shafts longer than those of the irons 27, the woods 33 are readily visible when the club heads are viewed from near the apex edge 17. There is another area 35 adjacent the apex edge 17 for receiving "short-game" clubs, such area 35 including an opening PW for a pitching wedge, an opening SW for a sand wedge and an opening P for a putter. It is to be appreciated that when the woods 35 and short-game clubs 37 are in place, the bag 10 nevertheless retains its orderly, easily-viewed characteristics. This is so since the taller clubs, the woods 33, are at the rear and the shortest clubs, the wedges and putter, are at the front of the bag 10.

Considering FIGS. 1 through 4, the bag 10 also has a base or bottom portion 25 and a pair of generally flat interior separator webs 23*a*, 23*b* extending the length of the bag 10 between the mouth 11 and the bottom portion 25 as shown in dashed outline 26 in FIG. 2. One such web 23*a*, 23*b* is inward of each row 19, 21 and spaced from and generally parallel to a side panel 39*a*, 39*b*. When so arranged, each web 23*a*, 23*b* and its adjacent side panel 39*a*, 39*b* respectively define a slotlike space 41*a*, 41*b* extending the length of the bag 10.

With the irons 27 in place in the bag 10, each web 23*a*, 23*b* and panel 39*a* and 39*b* respectively, (which generally "define" a row 39*a*, 39*b*) substantially prevent the club shafts from moving laterally (toward or away from the side panel) out of alignment with one another. And the thicknesses of the shafts and their generally row-like relationship helps keep the shafts from moving longitudinally (toward or away from the apex edge 17) out of alignment with one another. Therefore, since the shafts are relatively well aligned, the heads of irons 27 are likewise maintained generally in alignment. This provides not only a very neat appearance but an orderly "array" of clubs from which the desired club may be quickly selected.

And that is not all. The new bag 10 has a number of other desirable features. For example, the bag 10 includes a shoulder strap 43 preferably attached along the base edge 13. Since the side panels 39*a*, 39*b* are soft and generally flat, the bag 10 tends to lie close to the user's body when carried by such strap 43. And generally flat side panels 39*a*, 39*b* provide a much larger, more comfortable body contact area than do round or otherwise-curved bags, especially those made of hard molded materials. The new bag 10 thereby helps avoid places where the body may actually become chafed or slightly bruised from constant rubbing or "banging" against the bag 10 as the user walks the course.

Yet another convenience is that the bottom 25 portion of the bag 10 has a triangular shape and a generally flat ground-contacting surface 45. It may be said that when the bag 10 stands upright and rests on the bottom portion 25, its "footprint" is triangular. The bag 10 therefore has a better degree of stability against tipping than do conventional bags with round bottom portions. With such more stable arrangement, players find it less-frequently necessary to lay the bag 10 on the ground.

Figure 5:
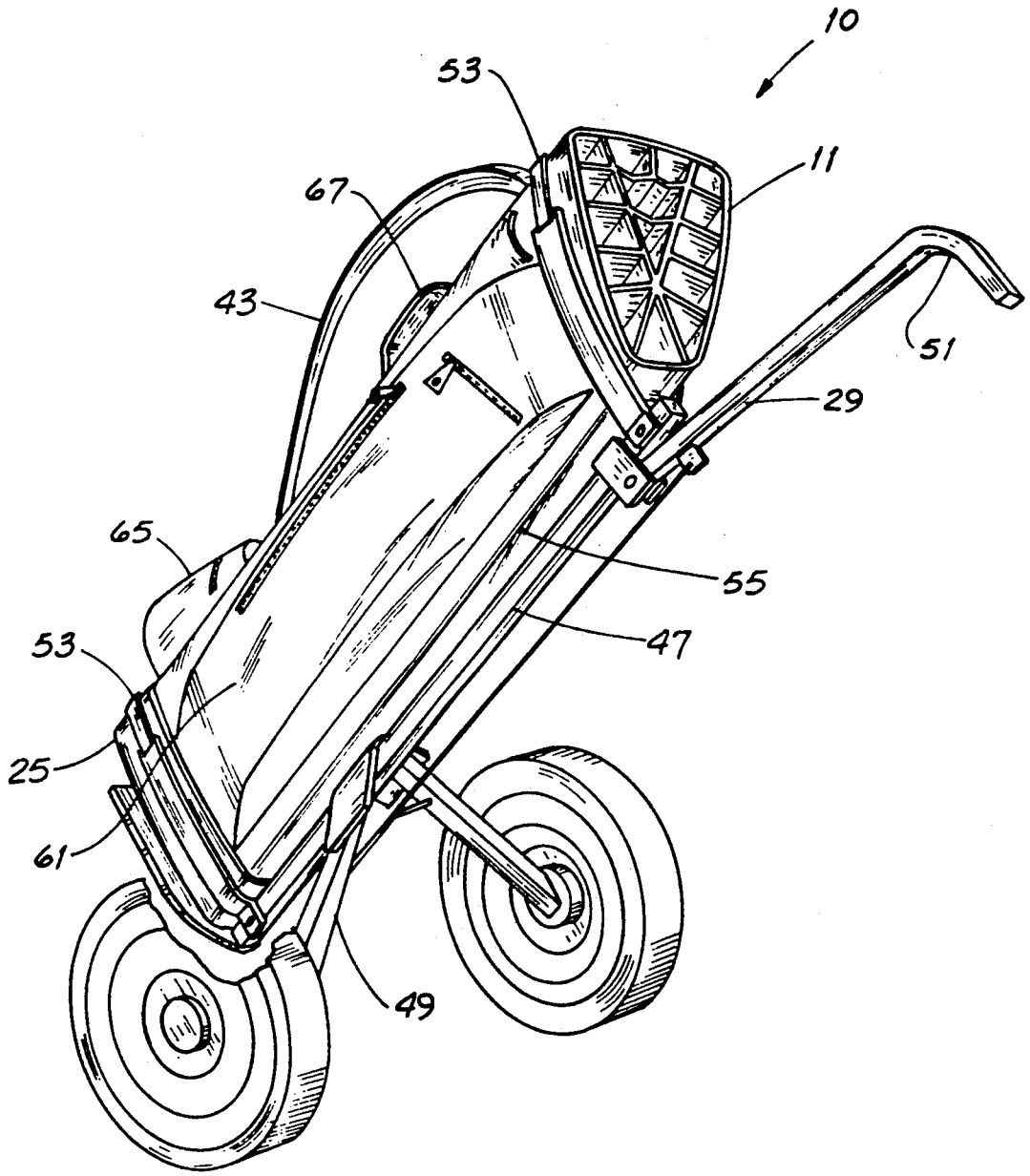
FIG. 5 is a perspective view of the bag of FIG. 1 shown in conjunction with a hand-pulled golf cart, with parts broken away.

Referring next to FIG. 5, the new bag 10 also accommodates the needs of the multitude of golfers who use a two-wheeled hand-pulled bag cart 29. Many such carts have a rigid bar-like stem 47 extending between the wheel frame 49 and the handle 51. Upper and lower V-shaped bag retention brackets 53 are attached to the stem 47 and diverge outward to receive and secure the bag 10, usually with straps extending between bracket ends. The inventive bag 10 includes an apex panel 55 devoid of straps and pockets. Such panel 55, being free of obstructions, may therefore be positioned closely adjacent and generally parallel to the cart stem 47 for more secure bag carrying. That is, the new bag 10, having a generally V-shaped cross-section along its length and being devoid of obstructions on the apex panel 55, provides a shape that may be said to be "cart-conforming" or "bracket-conforming." And the shoulder strap 43, being positioned away from the cart 29, is readily accessible for easier bag mounting and later removal from the cart 29.

Considering FIGS. 2–5, each row 19, 21 is bounded in part by a side edge 15*a*, 15*b* and an interior web 23*a*, 23*b* generally parallel to it. Each opening 19*a*, 21*a* is bounded in part by a web 56 supporting the shaft of an iron 27 and extending between a web 23*a*, 23*b* and a side edge 15*a*, 15*b*. When the mouth 11 is viewed with the bag 10 tipped toward the apex edge 17, each support web 56 angles from the interior web 23*a*, 23*b* downward and outward to the side edge 15*a*, 15*b*. When the bag 10 is so constructed, the shafts of irons 27 in each row 19, 21 are adjacent to a side edge 15*a*, 15*b* when the bag 10 is tipped toward the apex edge 17. The irons 27 in each row 19, 21 are thereby slightly spaced laterally from one another for easy removal from the bag 10.

Other features of the bag include a jewelry/glove pocket 57, a clothing pocket 59, a clothing and accessory pocket 61 and an umbrella sheath 63. The pockets 57, 59 are preferably on the right side of the bag 10 (as viewed in FIG. 1) while the pocket 61 and sheath 63 are on the left side (as viewed in FIG. 2). A ball pocket 65 is provided on the base edge 13 near the bottom portion 25. Such location of the pocket 65 lowers the center of gravity somewhat and helps provide greater stability when the bag 10 is free-standing. A carrying handle 67 is also provided on the base edge 13.

While the principles of the invention have been described in connection with specific embodiments, it should be understood clearly that these are examples and that the invention is not intended to be limited thereby.

I claim:

1. An improved golf bag including:

an upper mouth generally defining a truncated triangle and having a base edge, a pair of side edges extending from such base edge and a narrow apex edge extending between such side edges;

a row of openings generally parallel to each side and converging with the other row, each opening in each row being identified to a particular iron; whereby all irons are retained in two rows and in an ordered position and identifier arrangement and a particular iron is easily selected from such bag.

2. The golf bag of claim 1 wherein such rows of openings include a first row of openings identified to receive even-numbered irons and a second row of openings identified to receive odd-numbered irons.

3. The golf bag of claim 1 wherein such rows include first and second rows, each of which has openings numbered in sequence.

4. The golf bag of claim 1 containing golf clubs with shafts and further including a bottom portion and a pair of separator webs extending between such mouth and such portion, one such web being inward of each row and spaced from and generally parallel to a side panel which extends from one of said side edges for preventing lateral movement of the shafts whereby the heads of irons are maintained generally in alignment.

5. An improved golf bag including:

an upper mouth generally defining a truncated triangle and having a base edge, a pair of side edges extending from such base edge and a narrow apex edge extending between such side edges;

a row of openings adjacent to each side edge including a first row of openings, each identified to receive an even-numbered iron and a second row of openings, each identified to receive an odd-numbered iron;

a woods-receiving area adjacent to the base edge and interposed between such rows, whereby such irons and woods are readily visible when viewed from near the apex edge, irons are retained in an ordered arrangement and a particular iron is easily selected from the bag.

6. The golf bag of claim 5 further including an area adjacent to the apex for receiving "short game" clubs.

7. An improved golf bag including:

an upper mouth generally defining a truncated triangle and having a base edge, a pair of side edges extending from such base edge and a narrow apex edge extending between such side edges;

a row of openings adjacent to each side edge, the openings of each row numbered in sequence and thereby identified to a particular iron;

a woods-receiving area adjacent to the base edge and interposed between such rows, whereby such irons and woods are readily visible when viewed from near the apex edge, irons are retained in an ordered arrangement and a particular iron is easily selected from the bag.

8. In combination, an improved golf bag containing a plurality of irons, each with a shaft and a head and including:

an upper mouth generally defining a truncated triangle and having a base edge and a narrow apex edge;

openings for containing at least irons #2 through #9 and arranged in two rows converging adjacent to the apex edge, the openings in one row identified to an even-numbered iron contained therein and the openings in the other row identified to an odd-numbered iron contained therein;

each row containing irons having progressively shorter shafts as the row is viewed from the base edge to the apex edge, and;

heads of longer-shafted irons protruding from the bag a distance greater than the heads of shorter-shafted irons whereby the irons are readily visible and a particular iron is easily selected from the bag.

9. The combination of claim 8 wherein:

the rows are arranged in a "V";

each row is bounded in part by a side edge and an interior web generally parallel to the side edge;

each opening is bounded in part by a web supporting the shaft of an iron and extending between the interior web and a side edge;

when the mouth is viewed with the bag tipped toward the apex edge, each such support web angles from the interior web downward and outward to the side edge, the shafts of irons in each row being adjacent to a side edge when the bag is tipped toward the apex edge, whereby the irons in each row are slightly spaced laterally from one another for easy removal from the bag.

10. The combination of claim 9 wherein each iron has a head hanging downward generally parallel to the heads of other irons.

11. In combination, a hand-pulled bag cart having a bar-like stem and carrying a golf bag and the bag includes:

an upper mouth generally defining a truncated triangle bounded by a base edge, a pair of side edges and a narrow apex edge;

a row of openings adjacent to each side edge including a first row of openings, each identified to receive an even-numbered iron and a second row of openings, each identified to receive an odd-numbered iron;

an apex panel extending from the apex edge, devoid of straps and pockets and positioned generally adjacent to the stem for secure carrying of the bag.

12. The combination of claim 11 wherein the bag further includes:

a base panel extending from the base edge and spaced from the stem and the apex panel;

a carrying strap attached to the base panel, whereby such strap is readily accessible on the cart-carried bag.

* * * * *

UNITED STATES PATENT AND TRADEMARK OFFICE

CERTIFICATE OF CORRECTION

PATENT NO. : 5,125,507

DATED : June 30, 1992

INVENTOR(S) : Joseph M. Graziano, Jr.

It is certified that error appears in the above-identified patent and that said Letters Patent is hereby corrected as shown below:

In column 6, line 3, delete "39a, 39b" and insert --19, 21--.

In claim 1, line 25, after "side", insert --edge--.

Signed and Sealed this

Twenty-fourth Day of August, 1993

Bruce Lehman

*Attest:*

BRUCE LEHMAN

*Attesting Officer*

*Commissioner of Patents and Trademarks*